United States Patent [19]

Liao

[11] Patent Number: 4,878,404

[45] Date of Patent: Nov. 7, 1989

[54] ELECTRIC SCREWDRIVER

[76] Inventor: Hsieh-Yuan Liao, No. 33-35; Lane 246, Hsin Ming Road, Nei Hu Dist., Taipei, Taiwan

[21] Appl. No.: 245,987

[22] Filed: Sep. 14, 1988

[51] Int. Cl.[4] ..... B25B 21/00

[52] U.S. Cl. ..... 81/54; 81/52

[58] Field of Search ..... 81/52, 54, 429; 173/13, 173/15

[56] References Cited

U.S. PATENT DOCUMENTS 4,617,843 10/1986 Nishida et al. ..... 81/429 X

*Primary Examiner*—James G. Smith

*Attorney, Agent, or Firm*—Browy & Neimark

[57] ABSTRACT

An electric screwdriver includes a housing, a power output end, and a control cylinder mounting therein an active shaft connecting thereto a following shaft connecting thereto a driver mounting piece axially slidably mounted in a cap cylinder and a torsion-adjusting cylinder wherein the mounting piece has an engaging end attaching thereto a flange attaching thereon a light-shielding piece capable of shielding the light emitted by a photic control switch mounted on the control cylinder to allow the motor in the housing to be energized when the mounting piece mounts thereon a driver urging against a screw.

1 Claim, 3 Drawing Sheets

ELECTRIC SCREWDRIVER

BACKGROUND OF THE INVENTION

The present invention relates to a screwdriver, and more particularly to an electric screwdriver.

The conventional electric screwdriver uses a lever-type switch or a press-type switch either of which is mechanical and suffers from the following disadvantages:

(1) Since it is mechanical therefore includes numerous parts operated by leverage, the levering connection between the parts gets out of order easily.

(2) Upon conducting, an arc will be incurred to oxidize and etch away the switch junction to invalidate the function of the switch.

Therefore by Applicant attempts to deal with the problems above described.

SUMMARY OF THE INVENTION

It is therefore on object of the present invention to provide a switch for the electric screwdriver capable of effective and enduring operation.

According to the present invention, an electric screwdriver includes a housing, a power output end, and a control cylinder mounting therein an active shaft connecting thereto a following shaft connecting thereto a driver mounting piece axially slidably mounted in a cap cylinder and a torsion-adjusting cylinder wherein the mounting piece has an engaging end attaching thereto a flange attaching thereon a light-shielding piece capable of shielding the light emitted by a photic control switch mounted on the control cylinder to allow the motor in the housing to be energized when the mounting piece mounts thereon a driver urging against a screw.

BRIEF DESCRIPTION OF THE DRAWINGS

The present invention may best be understood through the following description with reference to the accompanying drawings, in which.

DETAILED DESCRIPTION OF THE PREFERRED EMBODIMENT

Figure 1:
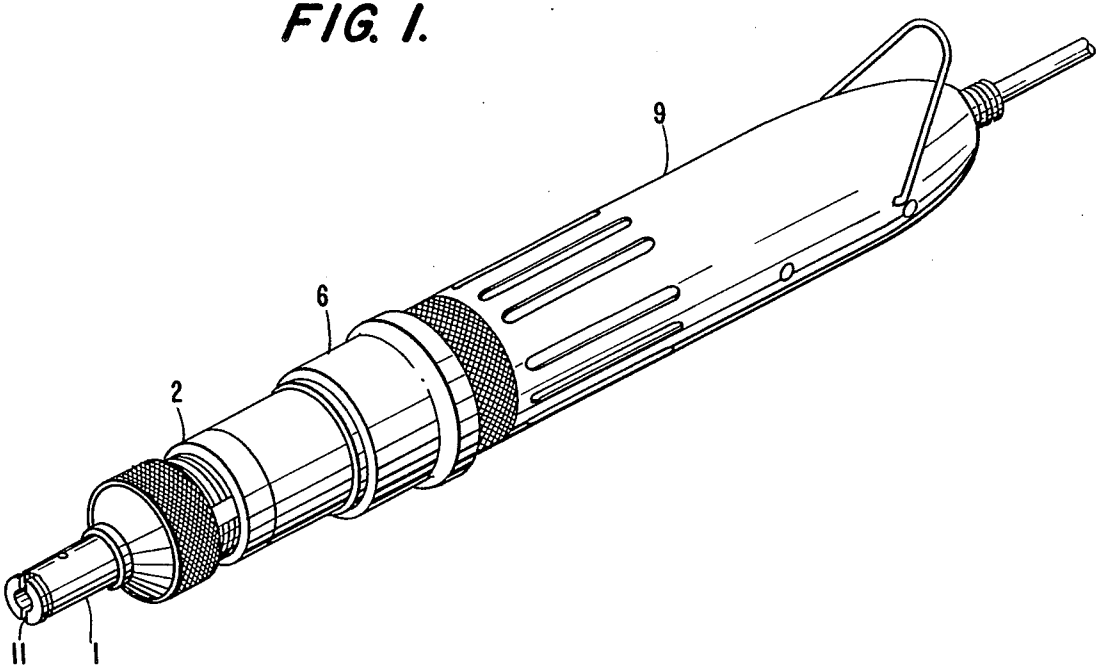
FIG. 1 is a perspective view showing a first preferred embodiment of an electric screwdriver according to the present invention.
Figure 2:
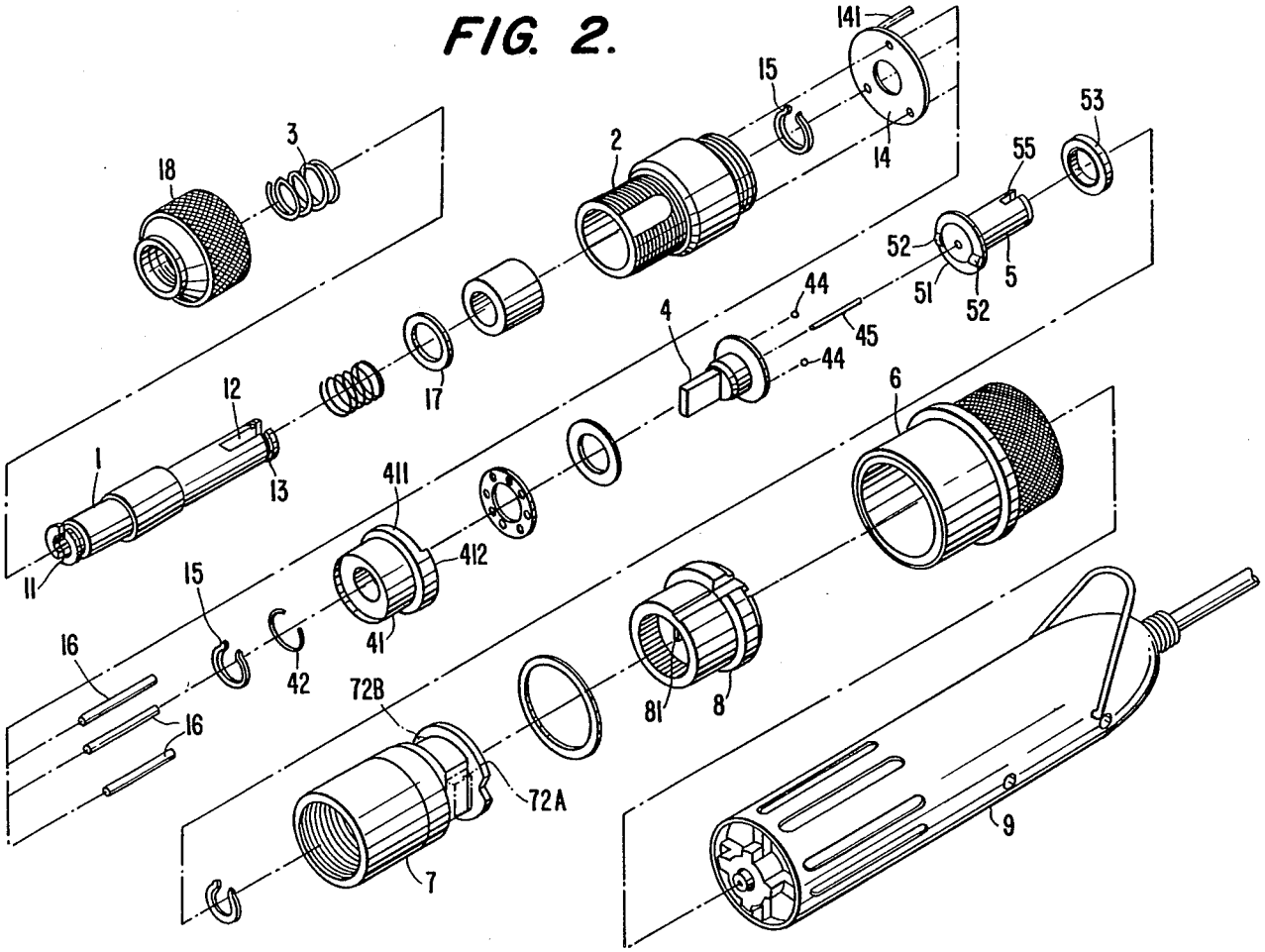
FIG. 2 is an exploded view of an electric screwdriver of FIG. 1.
Figure 3:
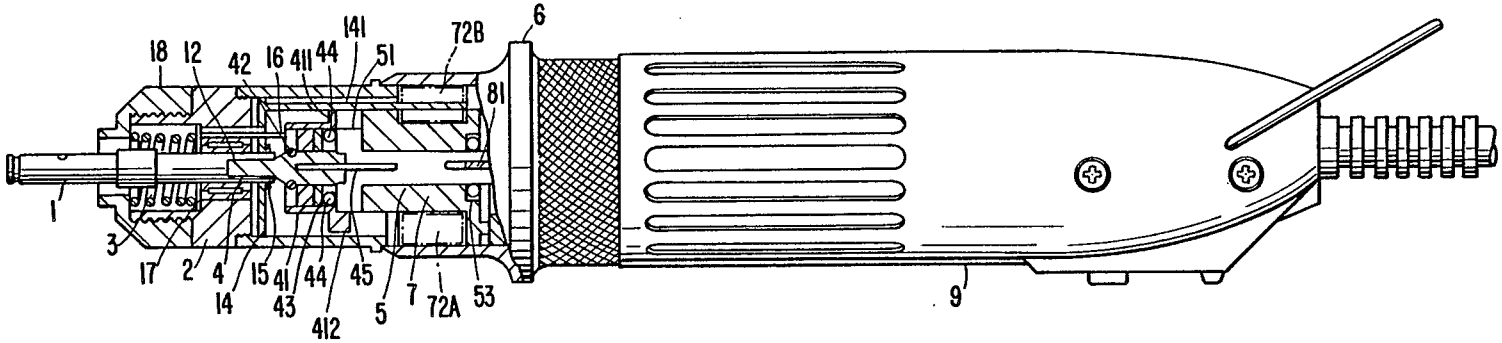
FIG. 3 is a sectional view of an electric screwdriver of FIG. 1.

Referring now to FIGS. 1–3, an electric screwdriver according to the present invention includes a first housing 9 securing therein a motor, a second housing 6 connected to first housing 9 and receiving therein a gear assembly 8 having a rotatable power output end 81, a control hollow cylinder 7, an active shaft 5, a following shaft 4, a torsion-setting spring 3, a torsion-adjusting hollow cylinder 2, a cap hollow cylinder 18, and a driver mounting piece 1 having a first axially slit end 11 capable of mounting thereon one of kinds of different drivers and a second axially slit end 12 having two annular grooves 13 on which two retainers 15 rest for retaining on second engaging end 12 a stopper flange 14 attaching thereon a light-shielding piece 141 and having three holes passing therethrough three positioning pins 16 having one of their ends thereof supported by an annulus 17 cooperating with cap cylinder 18 for mounting therebetween torsion-setting spring 3.

The other ends of pins 16 urge against a hollow mounting cylinder 41 rotatably receiving and retaining therein by a retainer 42 the following shaft 4 which engages with second engaging end 12, is aligned with active shaft 5 by an aligning pin 45, and includes two recesses 43 partly receiving therein two balls 44. Mounting cylinder 41 further includes a flange 411 having a reflecting block 412 and capable of passing therethrough light-shielding piece 141.

Control cylinder 7 having a first end fixed to second housing 6 and a second end connecting thereto torsion-adjusting cylinder 2 is provided with two oppositely disposed photic control switches 72A, 72B. Switch 72B is electrically connected to the motor and capable of emitting a light to be shielded by light-shielding piece 141 to energize the motor.

Active shaft 5 having a flanged end 51 having two protuberances 52 capable of stopping against balls 44 if the torsion between shafts 4 and 5 is under a predetermined level as a result of spring 3 and cylinder 2, is rotatably received in control cylinder 7 by retaining thereon a roller bearing 53 against control cylinder 7 and has a second axially slit end 55 engaging with output end 81.

When the driver mounted under slit end 11 is urged against a screw to engage engaging end 12 with following shaft 4 and to upwardly raise light-shielding piece 141 to shield the light emitted by switch 72B, the motor will be energized for enabling the driver to screw up the screw until the time that the predetermined torsion is reached upon which time balls 44 will slide across protuberances 52 which enables mounting cylinder 41 to have an instantaneous axial movement in a manner that reflecting block 412 of mounting cylinder 41 will reflect the light emitted by switch 72A to have switch 72A switch off the motor.

What I claim is:

1. An electric screwdriver comprising a housing securing therein a motor, a power output end rotatably mounted said housing and driven by said motor, a control hollow cylinder having a first end secured to said housing and a second opposite end, an active shaft connected to said power output end and rotatably mounted in said control cylinder, a cap hollow cylinder, a torsion-adjusting hollow cylinder mounted between said cap cylinder and said second opposite end, a driver mounting piece axially slidably mounted in said cap and torsion-adjusting cylinders, a following shaft mounted between said mounting piece and said active shaft for transmitting a rotating power from said active shaft to said driver mounting piece, and a spiral spring mounted between said cap and torsion-adjusting cylinders for providing a spring force against said following shaft, characterized in that: said mounting piece has an engaging end, which is the end engaging with said following shaft, attaching thereto a flange;

said control cylinder mounts thereon a photic control switch electrically connected to said motor to emit a light to de-energize said motor; and said flange attachs thereon a light-shielding piece shielding said light to energize said motor when said mounting piece mounts thereon a driver urging against a screw.

* * * * *